US008172356B2

(12) United States Patent
Portela et al.

(10) Patent No.: US 8,172,356 B2
(45) Date of Patent: May 8, 2012

(54) SYNCHRONIZED SPEED FOR NOZZLE HEALTH SCANNING

(75) Inventors: Laura Portela, Barbera del Valles (ES); Carlos Ciuraneta Sanchez, Terrasse Barcelona (ES); Jordi Ferran, Cerdanyola del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 178 days.

(21) Appl. No.: 12/464,244

(22) Filed: May 12, 2009

(65) Prior Publication Data

US 2010/0289846 A1 Nov. 18, 2010

(51) Int. Cl.
*B41J 29/393* (2006.01)

(52) U.S. Cl. ..... 347/19

(58) Field of Classification Search ..... 347/19, 347/81, 4, 5, 8

See application file for complete search history.

(56) References Cited

U.S. PATENT DOCUMENTS

| | | | | |
|---|---|---|---|---|
| 5,627,571 | A | 5/1997 | Anderson et al. | |
| 7,163,275 | B2 | 1/2007 | Yeh et al. | |
| 2007/0064041 | A1 * | 3/2007 | Sugahara | 347/19 |

FOREIGN PATENT DOCUMENTS

JP 2006110964 A * 4/2006

* cited by examiner

*Primary Examiner* — Lamson Nguyen
(74) *Attorney, Agent, or Firm* — Chun-Liang Kuo

(57) ABSTRACT

A method for nozzle health scanning including repositioning at least one moving platform at a synchronized speed for a drop detection sensor to scan nozzles in a set of nozzles firing, where the synchronized speed is based on a rate of firing from nozzles in the set of nozzles and a distance between the nozzles in the set of nozzles, and storing the health of the nozzles in a computer readable memory accessible by a machine.

19 Claims, 6 Drawing Sheets

SYNCHRONIZED SPEED FOR NOZZLE HEALTH SCANNING

BACKGROUND

When scanning nozzles in a die, multiple drop detection sensors or a larger and wider drop detection sensor are often used. The nozzles are instructed to fire and the drop detection sensor(s) are configured to measure ink fired from the nozzles with a light beam emitted from the drop detection sensor(s).

BRIEF DESCRIPTION OF THE DRAWINGS

Various features and advantages of the disclosed embodiments will be apparent from the detailed description which follows, taken in conjunction with the accompanying drawings, which together illustrate, by way of example, features of the disclosed embodiments.

DETAILED DESCRIPTION

Figure 1:
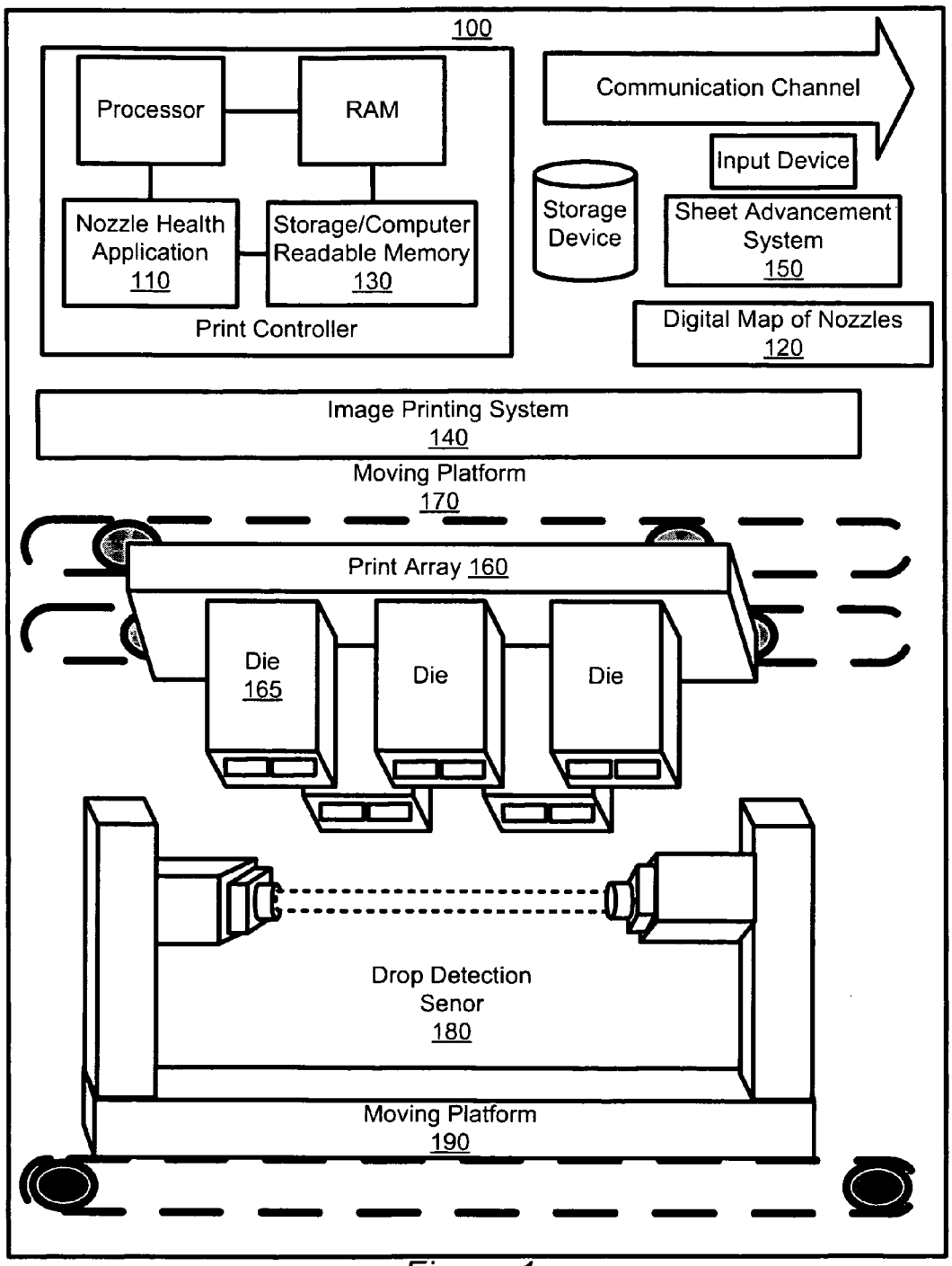
FIG. 1 illustrates a printing machine storing a nozzle health application, various components and devices included in the printing machine, and various components and devices coupled to the printing machine according to an embodiment of the invention.

FIG. 1 illustrates a printing machine 100 storing a nozzle health application 110, various components and devices included in the printing machine 100, and various components and devices coupled to the printing machine 100 according to an embodiment of the invention. A printing machine 100 is a machine 100 that accesses print data from at least one print job to print one or more images, text, and/or patterns on one or more sides of a sheet of media upon instruction. In one embodiment, the printing machine 100 is a web press.

As illustrated in FIG. 1, the printing machine 100 includes a print controller, a communication channel, a storage device, an input device, an image printing system 140, a sheet advancement system 150, a print head array 160 with multiple dies 165 coupled to a moving platform 170, and a drop detection sensor 180 coupled to an additional moving platform 190 according to an embodiment of the invention. Additionally, as illustrated in FIG. 1, the print controller which further includes a PROCESSOR, RAM, computer readable memory 130, and nozzle health application 110. In other embodiments, the printing machine 100 includes additional devices and/or components and is attached and/or coupled to additional devices or components in addition to and/or in lieu of those depicted in FIG. 1.

As noted above, the printing machine 100 includes a sheet advance system 150 which advances media on the printing machine 100 using a rotor and/or an additional moving mechanism under an image printing system 140 to print images and/or patterns on the media. Additionally, as illustrated in FIG. 1, a print array 160 is coupled to the image printing system 140. As noted above, the print array 160 includes multiple dies 165. The dies 165 further include nozzles configured to discharge or fire ink onto media advancing through the printing machine 100 to form images and/or patterns upon instruction by the print controller and/or a nozzle health application 110. As illustrated in FIG. 1, the nozzles fire ink through a beam light of a drop detection sensor 180 for the nozzle health application 110 to determine a corresponding nozzle health. Further, as illustrated in FIG. 1, the printing machine 100 includes at least one moving platform that repositions along one or more axis. At least one moving platform includes moving platform 170 and additional moving platform 190. Moving platform 170 and additional moving platform 190 are devices and/or mechanisms that reposition the print array 160 and/or the drop detection sensor 180 back and forth over media following a left to right or right to left path using rollers, rotors, and/or additional moving mechanisms.

As illustrated in FIG. 1, the print array 160 is coupled to moving platform 170 as part of the image printing system 140. In one embodiment, moving platform 170 repositions the print array 160 over the beam light of a drop detection sensor 180 following a direction orthogonal or parallel to the drop detection sensor 180. In another embodiment, the drop detection sensor 180 is repositioned to different positions under one or more nozzles in the print array 160 by additional moving platform 190 following a direction orthogonal or parallel to the direction of nozzles firing. In other embodiments, both moving platform 170 and additional moving platform 190 are configured to reposition at a synchronized speed and following a direction orthogonal or parallel to one another.

A drop detection sensor 180 is a device coupled to additional moving platform 190 on the printing machine 100 that is configured to detect an emission or firing of nozzles from on the print array 160 utilizing a beam light. In one embodiment, additional drop detections sensors are utilized separately or in conjunction with the drop detection sensor 180. In one embodiment, additional moving platform 190 is instructed by a nozzle health application 110 to reposition the drop detection sensor 180 orthogonally or in parallel under firing nozzles so that the drop detection sensor 180 scans and measures ink drops for the nozzle health application 110 to analyze and store.

As noted above and illustrated in FIG. 1, the printing machine 100 includes a print controller. The print controller in conjunction with a nozzle health application 110 is used to control the printing machine 100 and/or components and devices included in or coupled to the printing machine 100. Additionally, the print controller includes a PROCESSOR, RAM, Storage/Computer Readable Memory 130, and the nozzle health application 110. The nozzle health application 110 sends instructions to at least one moving platform 170, 190 to reposition and for the nozzles in the print array 160 to fire when aligned with the drop detection sensor 180. In Addition, the nozzle health application 110 receives signals and measurements from the drop detection sensor 180 to analyze and stored a corresponding nozzle health for the nozzles scanned.

The nozzle health application 110 is firmware that is embedded onto the print controller or the printing machine 100. In other embodiments, the nozzle health application 110 is a software application stored on the printer machine 100 through a storage medium readable and accessible by the printing machine 100 or the nozzle health application 110 is stored on a computer readable memory or medium readable and accessible by the printing machine 100 from a different location. The nozzle health application 110 communicates with the print controller and/or other additional devices and/or components connected to the printing machine 100 physically or wirelessly through one or more communication channels included in or attached to the printing machine 100.

As noted above, the nozzle health application 110 analyzes and stores a nozzle health for the nozzles on the print array 160 by instructing nozzles on the print array 160 to fire and instructing a drop detection sensor 180 to scan the ink fired from the nozzles. In analyzing and storing a nozzle health the nozzles in the print array 160, the nozzle health application 110 initially subsets the nozzles on the print array 160 into sets of nozzles to scan.

In one embodiment, the sets of nozzles subsetted by the nozzle health application 110 have a fixed size that is previously defined by the nozzle health application 110. Additionally, the number of nozzles included in the sets (the size of the set) is based on a rate of firing for nozzles in the dies 165 and a speed variability of the rate of firing for nozzles in the print array 165. Once the print array 160 has been subsetted, the nozzle health application 110 proceeds to determine a location of the drop detection sensor 180 and which set of nozzles in the print array 160 to scan.

The nozzle health application 110 determines a current position of the drop detection sensor 180 by scanning the storage memory or a digital map of nozzles 120 on the printing machine 100 for a last know recorded position in memory. In other embodiments, the nozzle health application 110 determines the current position by instructing the nozzles in the print array 160 to refresh by firing the nozzles and scanning the digital map 120 for hits. Additionally, the position of the drop detection sensor 180 is determined using an encoder strip in conjunction with a sensor (not shown).

The digital map of nozzles 120 is a binary map indicating a position of the nozzles in the print array. In other embodiments, additional memory maps and/or storage devices are used to store positions of nozzles. As a result, the nozzle health application 110 has knowledge of which nozzle is firing at what time utilizing the digital map 120 of nozzles in order to accurately identify the location of the drop detection sensor 180. In other embodiments, additional moving platform 190 is linked to a grid, not shown, and the position and movement of the moving platform is monitored by the nozzle health application 110.

After determining the current position, the nozzle health application 110 identifies a set of nozzles from the print array 160 that has not been scanned by polling the storage memory or scanning the digital map 120. The nozzle health application 110 proceeds to update the drop detection sensor 180 position when a set of nozzles has been identified to not have been scanned. Additionally, the nozzle health application 110 will identify the first nozzle, the last nozzle, and the nozzles in between the first nozzle and the last nozzle, from the set of nozzles to scan.

In one embodiment, the nozzle health application 110 synchronizes the drop detection sensor 180 with a set of nozzles identified to be scanned by sending an instruction for additional moving platform 190 to position and align a beam light outputted from the drop detection sensor 180 under a first nozzle of the set of nozzles. In another embodiment, the nozzle health application 110 synchronizes the drop detection sensor 180 with the set of nozzles by configuring moving platform 170 to reposition the print array 160 so that the first nozzle of the set of nozzles is aligned over the beam light from the drop detection sensor 180.

Once the first nozzle is aligned of the beam light from the drop detection sensor 180, the synchronized position has been reached and the nozzle health application 110 determines a synchronized speed for additional moving platform 190 to advance the drop detection sensor 180 and/or moving platform 170 to reposition the print array 160 over the drop detection sensor 180. In one embodiment, the synchronized speed is constant if the rate of firing for the nozzles in the set of nozzles is constant and a distance between the nozzles is constant. In other embodiments, the synchronized speed is variable when the rate and/or speed of firing for the nozzles in the set of nozzles are different from one other.

In one embodiment, the synchronized speed is determined in consideration of at least one from the group consisting of a rate and speed of firing for nozzles in the set of nozzles, a distance between nozzles in the set of nozzles, a total number of nozzles in the set of nozzles, a width and/or length of the beam light emitted from the drop detection sensor, an amount of time to refresh nozzles in the set of nozzles, and/or a speed and position tolerance of at least one moving platform 170, 190.

The rate and speed of firing includes an amount of time for ink to be emitted from nozzles from the set of nozzles and a time difference between the firings of the nozzles in the set of nozzles. In one embodiment, the distance between the nozzles in the set of nozzles is determined by measuring a distance the drop detection sensor 180 travels when moving from one nozzle to another. In one embodiment, the nozzle health application 110 determines the rate and speed of firing. In other embodiments, a user defines the rate and speed of firing. Further, a nozzle set length is calculated by accumulating a length of the nozzles in the set of nozzles and a distance between the nozzles in the set of nozzles. The synchronized speed is determined in consideration of additional factors in addition to and/or in lieu of those noted above.

In one embodiment, an average synchronized speed is determined utilizing the following formula: Nozzle set length/[(Rate and speed of firing of the nozzles in the set of nozzle)*(Number of nozzles in set of nozzles)+Amount of time to refresh the nozzles in the set].

Further, in another embodiment, a max synchronized speed is determined utilizing the following formula: [Nozzle set length+(A width of the beam light from the drop detection sensor/2)]/[(Rate and speed of firing of the nozzles in the set of nozzle)*(Number of nozzles in set of nozzles)+Amount of time to refresh the nozzles in the set].

Additionally, a minimum synchronized speed is determined utilizing the following formula: [Nozzle set length−(A width of the beam light from the drop detection sensor/2)]/[(Rate and speed of firing of the nozzles in the set of nozzle)*(Number of nozzles in set of nozzles)+Amount of time to refresh the nozzles in the set].

In other embodiments, the nozzle health application 110 utilizes additional formulas to determine the synchronized speed. In instructing at least one moving platform 170, 190 to reposition, the nozzle health application 110 may utilize any of above noted, average, max, or minimum synchronized speeds. Additionally, the synchronized speed is further adjusted in consideration of a speed and position tolerance of at least one moving platform 170, 190. Further, in one embodiment, the rate of firing for the nozzles in the set of nozzles is also modified in consideration of a speed and position tolerance of at least one moving platform 170, 190.

After determining the synchronized speed, the nozzle health application 110 refreshes the set of nozzles by pre-firing the nozzles in the set of nozzles to be scanned. The nozzles are refreshed simultaneously before the drop detection sensor 180 begins to scan a set of nozzles. After the nozzles have been refreshed, the nozzle health application 110 proceeds to instruct the first nozzle of the set of nozzles to fire over the drop detection sensor 180 and through a beam light emitted from the drop detection sensor 180. The drop detection sensor takes signal measurements from the beam light for the nozzle health application 110 to analyze.

In one embodiment, once measurements have been taken from the firing of the first nozzle, the nozzle health application 110 instructs the additional moving platform 190 to reposition the drop detection sensor 180 to scan and measure subsequent nozzles in the set of nozzles at the synchronized speed following a direction orthogonal or parallel to firing nozzles. In other embodiments, the nozzle health application 110 instructs both moving platform 170 and additional moving platform 190 to reposition the print array 160 and the drop detection sensor 180 at the synchronized speed following a direction orthogonal or parallel to one another so that the drop detection sensor 180 will be aligned to receive and scan ink fired from subsequent nozzles in the set of nozzles.

The speed that at least one moving platform 170, 190 moves is synchronized when ink fired from the nozzles in the set of nozzles is received by the beam light on the drop detection sensor 180 while at least one moving platform 170, 190 is being repositioned. In addition, while scanning and measuring ink drops from subsequent nozzles in the set, the nozzle health application 110 concurrently analyzes the measurements from the first nozzle scanned and/or any additional nozzles already scanned to identify a corresponding nozzle health for the scanned nozzles. In another embodiment, the nozzle health application 110 postpones analyzing and identifying corresponding nozzle health of the scanned nozzles for a future time or until all of the nozzles in the set of nozzles have been scanned.

In analyzing the measurements, in one embodiment, the nozzle health application 110 compares measurement values to values stored or accessible by the printing machine 100 indicating that the nozzles are functioning correctly. If the compared measurements are outside a tolerance of the stored values, the nozzle health application 100 determines that the nozzle is not functioning correctly and need to be replaced or have maintenance performed on the corresponding nozzle. In other embodiments, the nozzle health application 110 stores these results in a storage device and/or computer readably memory on the printing machine and/or a device accessible by the printing machine 100 for future use.

After scanning and measuring the nozzle health of the last nozzle in the set of nozzles, the nozzle health application 110 determines whether the health of the nozzles in the set of nozzles was identified and whether there are any additional sets of nozzles in the print array that have not been scanned. The nozzle health application scans the digital map of nozzles to determine whether each nozzle has a corresponding nozzle health stored. In one embodiment, if the nozzle health application 110 determines that one or more nozzle health of previously scanned nozzles in the set were not able to be identified, the nozzle health application 110 instructs the moving platform 170 or additional moving platform 190 to reposition so that the drop detection sensor 180 is under the corresponding nozzles whose health was not identified. The nozzle health application then instructs the corresponding nozzle to re-fire and the drop detection sensor 180 to rescan and measure the ink fired.

Figure 2:
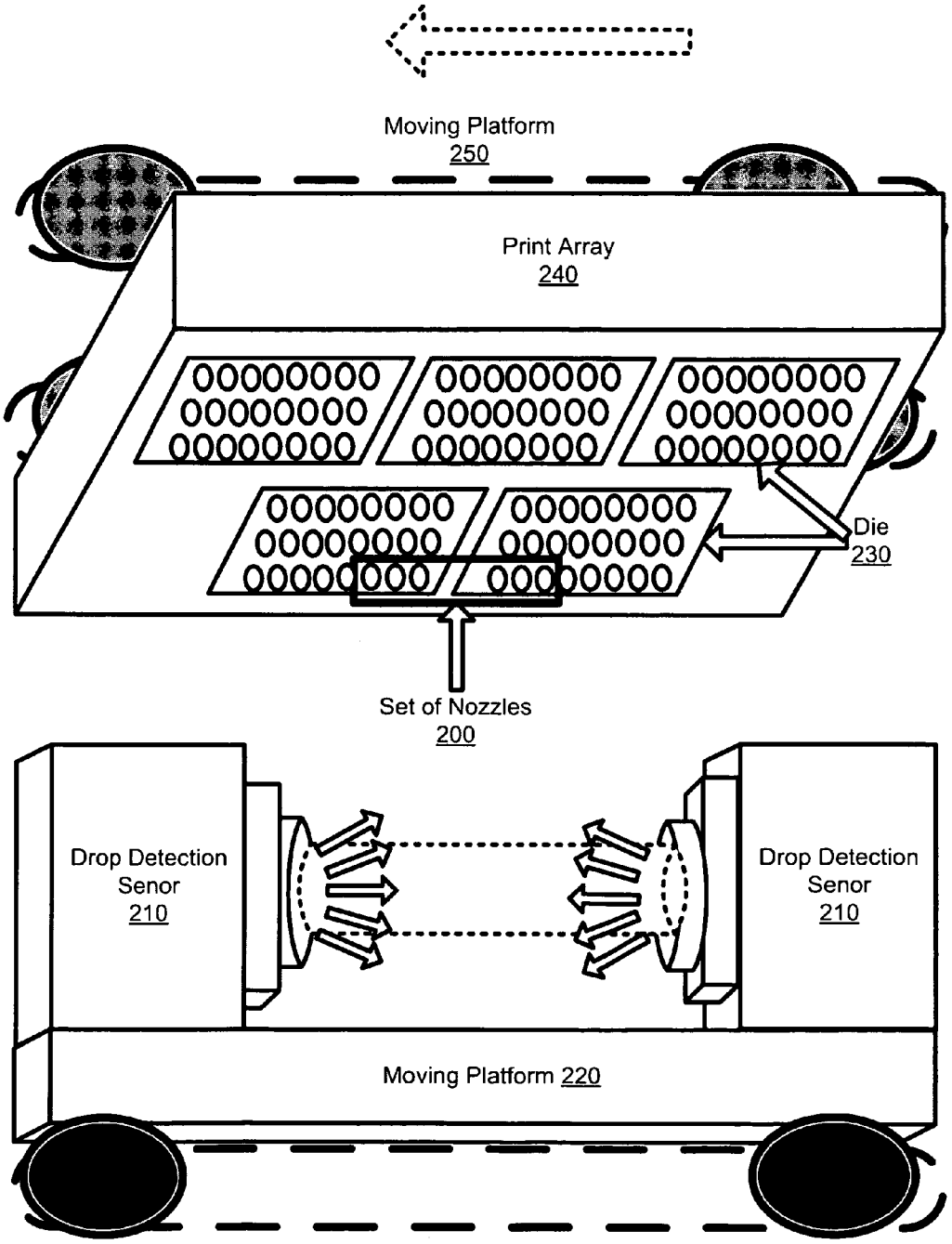
FIG. 2 illustrates a moving platform repositioning a print array with nozzles at a synchronized speed over a drop detection sensor to scan according to an embodiment of the invention.

FIG. 2 illustrates a moving platform 250 repositioning a print array 240 with nozzles at a synchronized speed over a drop detection sensor 210 to scan according to an embodiment of the invention. As noted above, the dies 230 are included in a print array 240. Additionally, the dies 230 include multiple nozzles configured to emit or fire ink out upon instruction by a nozzle health application on a printing machine. The dies 230 are coupled to the print array 240 and are positioned adjacent to additional dies 230.

Additionally, as noted above, the nozzles on the print array 240 are subsetted into one or more sets of nozzles 200 by a nozzle health application. A set of nozzles 200 is a group of nozzles that includes less than all of the nozzles on the print array 240. As illustrated in FIG. 2, in one embodiment, the set of nozzles 200 includes nozzles from more than one dies 230 that are adjacent to one another. As noted above, the size or the number of nozzles included in the sets of nozzles are fixed and are the same. Further, the number of set of nozzles subsetted and the fixed size of the sets of nozzles are based on a rate and/or speed of firing of the nozzles in the dies 230 and a variability in speed of the rate of firing nozzles in the print array 240.

Further, as illustrated in FIG. 2 and noted above, at least one drop detection sensor 210 is positioned under the print array 240 to scan and measure ink emitted and/or fired from nozzles. As noted above, at least one drop detection sensor 210 includes a beam light emitter and a beam light sensor to produce a beam light which is utilized to detect and scan ink drops that have been fired from nozzles in the print array 240. In one embodiment, the beam light is ultraviolet, infrared, and/or any additional portion of a light spectrum. The drop detection sensor 210 is mounted on a moving platform 220 and sends signals indicating a detection of ink passing through the beam light to the nozzle health application. Further, when ink is detected to pass through the beam light, the drop detection sensor takes measurements of the ink and sends signals containing the measurements to the nozzle health application to analyze.

As illustrated in FIG. 2, in one embodiment, the set of nozzles 200 on the print array 240 are moved in different directions at a synchronized speed utilizing a moving platform 250 coupled to the print array 240. As noted above and illustrated in FIG. 2, the moving platform 250 includes rotors, rollers, and/or additional moving mechanisms to reposition. In one embodiment, the moving platform 250 moves the print array 240 back and forth along an axis over a drop detection sensor 210 following a direction orthogonal or parallel to at least one drop detection sensor 210.

In the present embodiment, the nozzle health application sends an instruction for the moving platform 250 to align the first nozzle in the identified set of nozzles 230 to be scanned at the synchronization point and determine a synchronized speed to reposition the moving platform 250 using one of the formulas disclosed above, over the drop detection sensor 210, and fire. The nozzle health application then instructs the moving platform 250 to continually reposition to the left following a direction parallel to the drop detection sensor 210 so that the subsequent nozzles in the set of nozzles 200 which are about to fire are aligned over the drop detection sensor 210 when firing. The moving platform 250 is configured by the nozzle health application to repeat this repositioning to the left at the synchronized speed and firing until the last nozzle of the set of nozzles 200 has fired into the beam light of the drop detection sensor 210. As noted above, the nozzle health application scans the ink drops and determines a corresponding nozzle health for the nozzles in the identified set of nozzles to scan. Further, as noted above, the nozzle health application stores the corresponding nozzles health to memory.

Figure 3:
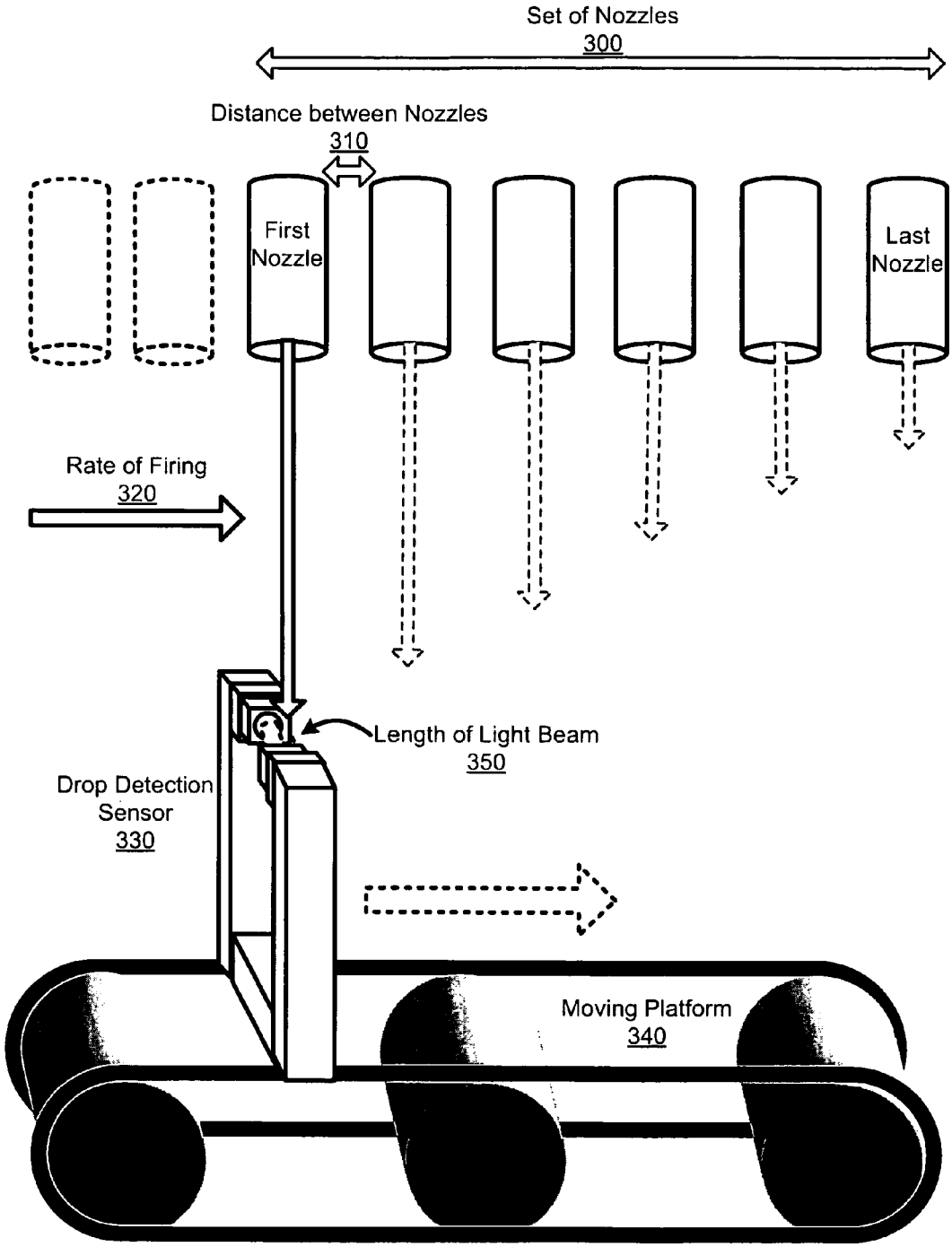
FIG. 3 illustrates an additional moving platform positioning a drop detection sensor at a synchronization point to scan a firing of a first nozzle and repositioning with the additional moving platform so as to scan a firing of all of the nozzles from the set of nozzles at a synchronized speed according to an embodiment of the invention.

FIG. 3 illustrates an additional moving platform 340 positioning a drop detection sensor 330 at a synchronization point to scan a firing of a first nozzle and repositioning with the additional moving platform 340 so as to scan a firing of all of the nozzles from the set of nozzles 300 at a synchronized speed according to an embodiment of the invention. As noted above, in one embodiment, a drop detection sensor 330 is coupled to additional moving platform 340 and repositions back and forth along an axis following a direction orthogonal to the firing of nozzles in a set of nozzles.

As illustrated in FIG. 3, in the present embodiment, the set of nozzles 300 includes 6 nozzles and the drop detection sensor 330 is positioned at a synchronization point (under the first nozzle of the set of nozzles 300) before scanning the nozzles firing in the set of nozzles 300. As noted above, after moving to a synchronization point, a nozzle health application determines a synchronization speed to continuously move and/or reposition the drop detection sensor 330 using additional moving platform 340.

Additionally, as noted above, the synchronized speed is determined using one of the formulas disclosed above or using additional formulas in consideration of a rate and speed of firing from nozzles in the set of nozzles 320, a distance between nozzles in the set of nozzles 310, a total number of nozzles in the set of nozzles (6 in the present embodiment), a width and/or length of the beam light emitted from the drop detection sensor 350, an amount of time to refresh nozzles (amount of time in firing every nozzle in the set of nozzles 300), and/or a speed and position tolerance of moving platform 340.

As illustrated in FIG. 3, the length of the beam light 350 is the distance from one end of the drop detection sensor 350 to the other end. The length of the beam light 350 is determined by the nozzle health application or be defined by a user. Additionally, the amount of time to refresh the nozzles is the amount of time for all of the nozzles in the set of nozzles 300 to fire. In one embodiment, the amount of time to each nozzle is equivalent to firing one nozzle, if all of the nozzles fire at the same rate and speed.

Further, as illustrated in FIG. 3, once the drop detection sensor 330 is at the synchronization point and the synchronization speed has been determined, the nozzle health application refreshes the nozzles in the set of nozzles and/or instructs the first nozzle of the set of nozzles 300 to emit ink. Additionally, as illustrated in FIG. 3, a beam light from the drop detection sensor 330 detects the firing of the first nozzle and sends a signal of the detection and measurement data taken from the scan to the nozzle health application. As illustrated in FIG. 3, additional nozzles from the set of nozzles 300 begins to fire before ink from the first nozzle has reached the beam light on the drop detection sensor 330. In addition, the nozzle health application instructs the additional moving platform 340 to begin moving and/or repositioning to the right for the drop detection sensor 330 to scan the next nozzle in the set of nozzles 300 following an orthogonal direction as soon as the first nozzle fires at the synchronized speed. As a result, the nozzles from the set of nozzles 300 are firing while the moving platform 340 is concurrently repositioning the drop detection sensor 330.

With the repositioning of the drop detection sensor 330 at the synchronized speed, time spent in scanning nozzles is saved in not waiting until ink from the first nozzle has been scanned before additional nozzles from the set of nozzles 300 begin firing. Additionally, with the repositioning of the drop detection sensor 330 and/or a print array at the synchronized speed, the drop detection sensor 330 is positioned below the corresponding firing nozzles to scan the corresponding inks with the beam light.

The nozzle health application continues to instruct additional moving platform 340 to reposition and advance the drop detection sensor 330 following the direction and flow of subsequent firings to scan and measure the nozzle health for the subsequent nozzles in the set of nozzles 300. Once the nozzle health of the last nozzle in the set of nozzles has been determined and stored in memory, the nozzle health application determines whether the nozzle health of the nozzles in the set of nozzles has been identified.

If not, the nozzle health application sends an instruction for the moving platform 340 to reposition the drop detection sensor 330 under a nozzle whose health was not identified and configures the corresponding nozzle to re-fire. In one embodiment, the nozzle health application determines that the nozzle health of the first nozzle in the set of nozzles 300 was not identified and the nozzle health application instructs the drop detection sensor 330 to reposition to the first nozzle and instruct the first nozzle to refire.

Figure 4:
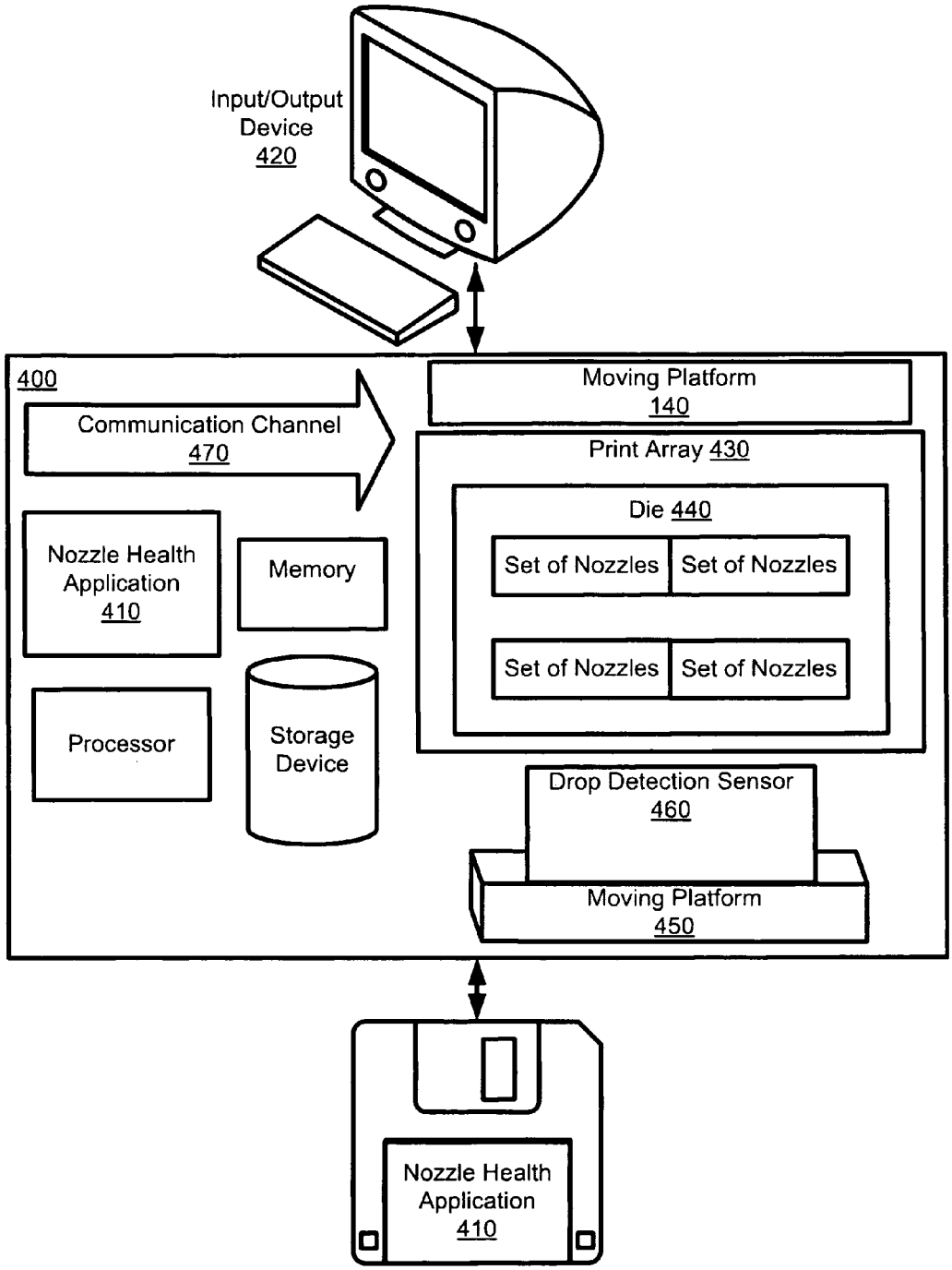
FIG. 4 illustrates a nozzle health application that is be embedded into a printing machine and/or is stored on a removable medium being accessed by a communication device on the printing machine according to an embodiment of the invention.

FIG. 4 illustrates a nozzle health application 410 that is be embedded into a printing machine 400 and/or is stored on a removable medium being accessed by a communication device on the printing machine 400 according to an embodiment of the invention. As noted above, the nozzle health application 410 controls and/or manages the hardware components of the printing machine 400 by sending instructions and/or commands to components of the printing machine 400 independently or in conjunction with a print controller using one or more communication channels 470.

Further, as noted above, in one embodiment, the nozzle health application 410 is firmware that is imbedded into one or more components of the printing machine 400. In another embodiment, the nozzle health application 410 is a software application which is stored and accessed from a hard drive, a compact disc, a flash disk, a network drive or any other form of computer readable medium that is coupled to the printing machine 100. In other embodiments, the nozzle health application 410 is stored and accessed from additional devices in addition to and/or in lieu of those noted above and depicted in FIG. 4.

Figure 5:
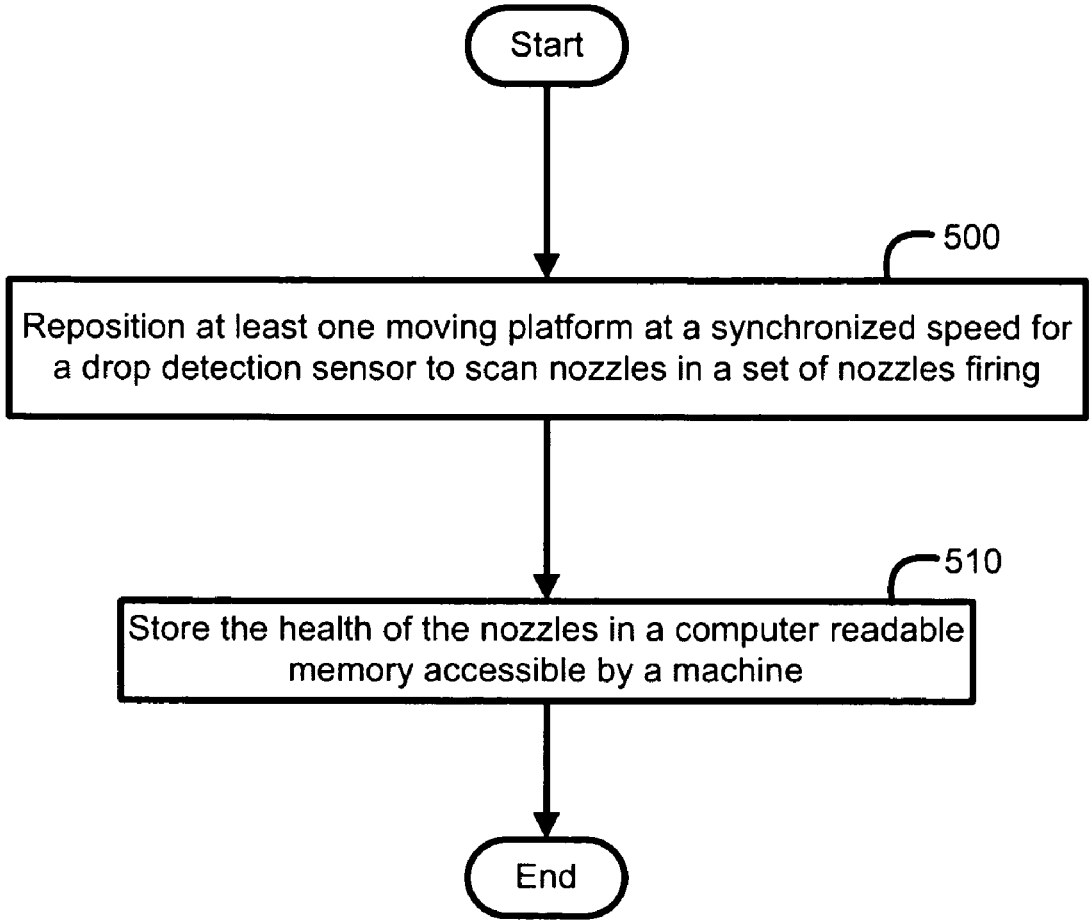
FIG. 5 is a flow chart illustrating a method for nozzle health scanning according to an embodiment of the invention.

FIG. 5 is a flow chart illustrating a method for nozzle health scanning according to an embodiment of the invention. The method of FIG. 5 utilizes a nozzle health application stored on computer readable memory, a print array with dies and nozzles, a drop detection sensor, and at least one moving platform. In other embodiments, the method of FIG. 5 utilizes additional components and/or devices in addition and/or in lieu of those depicted in FIGS. 1, 2, 3, and 4.

In one embodiment, in identifying a health of a nozzle, the nozzle health application initially identifies a set of nozzles in a print array to scan. After choosing the set of nozzles to scan, the nozzle health application instructs at least one moving platform to align a drop detection sensor and a first nozzle of the set of nozzles so as to synchronize with the set of nozzles. As noted above, the drop detection sensor is aligned when a beam light emitted from the drop detection sensor is under a first nozzle of the set of nozzles to scan. Once the drop detection sensor is in place, the nozzle health application repositions at least one moving platform at a synchronized speed so that the drop detection sensor scans the nozzles in a set of nozzles firing 500. As noted above, at least one moving platform will continue to reposition until the last nozzle in the set of nozzles has been scanned.

While scanning nozzles in the set of nozzles, the nozzle health application analyzes and stores the health of the nozzles in a computer readable memory accessible by a machine 510. In other embodiments, the nozzle health application analyzes and stores the nozzle heaths at a later time or once all of the nozzles from the set have been scanned. The method is then be complete, or the nozzle health application proceeds to instruct the moving platform to reposition the drop detection sensor at the next synchronized position of the next set of nozzles to scan and repeat the method disclosed above. In other embodiments, the method for identifying a health of a nozzle includes additional steps in addition to and/or in lieu of those noted above and illustrated in FIG. 5.

Figure 6:
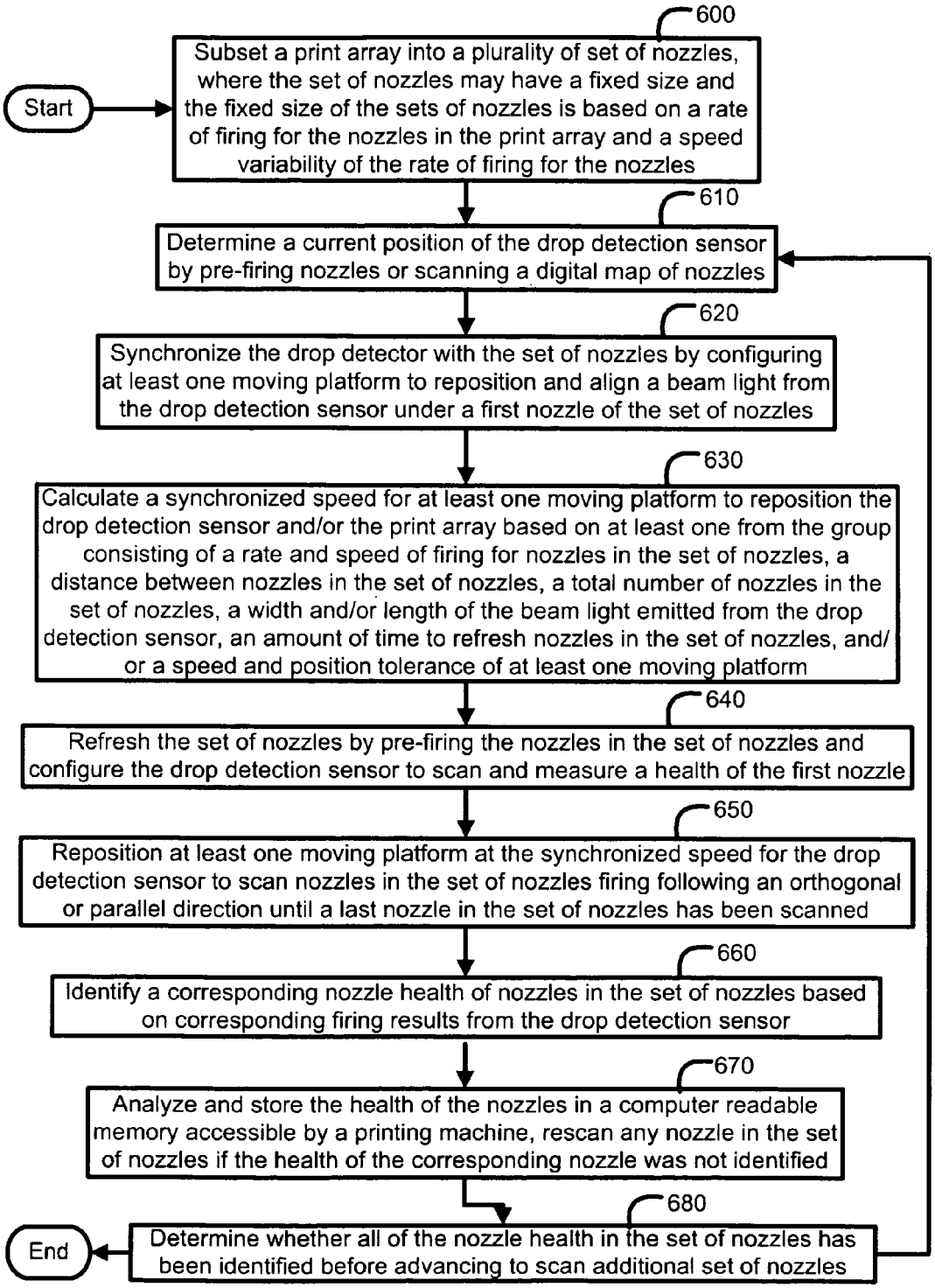
FIG. 6 is a method for nozzle health scanning according to another embodiment of the invention.

FIG. 6 is a flow chart illustrating a method for nozzle health scanning according to another embodiment of the invention. The method of FIG. 6 utilizes a nozzle health application stored on computer readable memory, a print array with dies and nozzles, a drop detection sensor, and at least one moving platform. In other embodiments, the method of FIG. 6 utilizes additional components and/or devices in addition and/or in lieu of those depicted in FIGS. 1, 2, 3, and 4.

As illustrated in FIG. 6, the nozzle health application initially subsets a print array into sets of nozzles, where the sets of nozzles have a fixed size and the fixed size of the sets of nozzles is based on a rate of firing for the nozzles in the print array and a speed variability of the rate of firing for the nozzles 600. As noted above, in one embodiment, a set of nozzles include nozzles from more than one die. After creating one or more subsets of nozzles, the nozzle health application prepares to begin to scan the nozzles in the set of nozzles.

In scanning the nozzles, the nozzle health application initially determines a current position of the drop detection sensor by pre-firing nozzles or scanning a digital map of nozzles 610. As noted above, in one embodiment, the nozzle health application scans a memory on a printing machine for the last know position or instructs the nozzles to refresh by firing the nozzles and examining a digital map of nozzles. Once the position of the drop detection sensor has been identified the nozzle health application synchronizes the drop detector with the set of nozzles by instructing at least one moving platform to reposition and align a beam light from the drop detection sensor under a first nozzle of the set of nozzles 620.

Once at least one moving platform has aligned at the synchronized point, the nozzle health application calculates a synchronized speed for the moving platform to advance the drop detection. As noted above, in one embodiment, the synchronized speed is based on at least one from the group consisting of a rate and speed of firing of nozzles in the set of nozzles, a distance between nozzles in the set of nozzles, a total number of nozzles in the set of nozzles, a width and/or length of the beam light emitted from the drop detection sensor, an amount of time to refresh nozzles in the set of nozzles, and/or a speed and position tolerance of at least one moving platform 630.

After identifying the synchronization speed, the nozzle health application refreshes the set of nozzles by pre-firing the nozzles in the set of nozzles and instructs the drop detection sensor to scan and measure a health of the first nozzle 640. As noted above, the drop detection sensor emits a beam light from one end to the other end of the drop detection sensor. Additionally, in scanning and measuring the health of a nozzle, the nozzle health application instructs the corresponding nozzle, to fire so that ink from the corresponding nozzle passes through the beam light and is analyzed by the nozzle health application.

Once the first nozzle from the set of nozzles has been fired and the beam light has scanned and measured the firing, the nozzle health application instructs at least one moving platform to reposition the print array and/or the drop detection sensor such that the drop detection sensor scans and measures the health of subsequent nozzles firing in the set of nozzles following an orthogonal or parallel direction 650. As noted above, at least one moving platform will reposition at the synchronized speed until a last nozzle in the set of nozzles has been scanned 650. In one embodiment the rate of firing is modified based on a speed or position tolerance of at least one moving platform.

In repositioning the drop detection sensor, the nozzle health application instructs the moving platform to reposition the drop detection sensor following a direction orthogonal to the direction and/or flow of firing from the set of nozzles according to an embodiment of the invention. In other embodiments, the nozzle health application instructs both the moving platform and an additional moving platform to reposition the drop detection sensor and the print array following a direction that is parallel to the direction and/or flow of firing.

While continuing to scan any un-scanned nozzles in the set of nozzles, the nozzle health application identifies a corresponding nozzle health of nozzles in the set of nozzles based on corresponding firing results from the drop detection sensor 660. In other embodiments, the nozzle health application identifies the corresponding nozzle health of the nozzles in the set after all of the nozzles from the set of nozzles have been scanned by the drop detection sensor. In identifying a corresponding nozzle health of the nozzles, the nozzle health application analyzes and stores the health of the nozzles in a computer readable memory accessible by a printing machine and concurrently rescans any nozzles in the set of nozzles if the health of the nozzle health application determines that the corresponding nozzle was not identified 670.

While identifying the corresponding nozzle health of the scanned nozzles, in one embodiment, the nozzle health application concurrently determines whether the nozzle health of all of the nozzles in set of nozzles has been identified before advancing to scan additional set of nozzles 680. The method is then complete or the nozzle health application proceeds to any additional un-scanned set of nozzles and continue to identify the corresponding health of the nozzles utilizing the method disclosed above.

By determining a synchronized speed to reposition at least one moving platform when scanning nozzles in a set of nozzles, at least one moving platform is repositioned at the synchronized speed so that the nozzles in the set of nozzles are scanned. As a result, resources and time are saved in not using a larger drop detection sensor or multiple drop detection sensors. Further, down time is decreased by not trouble shooting multiple drop detection sensors or a larger drop detection sensor.

What is claimed is:

1. A printing machine comprising:

a moving platform coupled to a print array;

an additional moving platform coupled to a drop detection sensor;

a print controller to reposition at least one moving platform at a synchronized speed such that a beam light from the drop detection sensor scans ink fired from nozzles in a set of nozzles of the print array and to record a nozzle health of the nozzles based on corresponding firing results detected by the drop detection sensor.

2. The printing machine of claim 1 wherein the synchronized speed that at least one moving platform moves at is based on at least one from the group consisting of a rate and speed of nozzles firing in the set of nozzles, a distance between nozzles in the set of nozzles, a total number of nozzles in the set of nozzles, a width and/or length of the beam light emitted from the drop detection sensor, an amount of time to refresh nozzles in the set of nozzles; and a speed and position tolerance of at least one moving platform.

3. The printing machine of claim 1 wherein the additional moving platform is configured to reposition the drop detection sensor to scan nozzles in the set of nozzles following a direction orthogonal or parallel to the set of nozzles.

4. The printing machine of claim 1 wherein the moving platform is configured to reposition the print array over the drop detection sensor following a direction orthogonal or parallel to the set of nozzles.

5. The printing machine of claim 1 wherein the print array is subset into sets of nozzles with a fixed size for the drop detection sensor to scan.

6. The printing machine of claim 5 wherein a number of sets of nozzles subsetted from the print array and the fixed size of the sets of nozzles is based on the rate of firing for nozzles in the print array and a speed variability of the rate of firing for nozzles in the print array.

7. The printing machine of claim 1 wherein the drop detection sensor outputs a beam light that scans and measures the health of nozzles from the set of nozzles firing.

8. A method comprising:

identifying a synchronized speed to reposition at least one moving platform of a printing machine based on a rate of firing from nozzles in a print array and a distance between the nozzles in the print array;

repositioning at least one of the moving platform at the synchronized speed for a beam light of a drop detection sensor to scan nozzles in the print array firing;

wherein the print array is coupled to a moving platform of the print machine and the drop detection sensor is coupled to an additional moving platform of the print machine; and identifying a health of the nozzles in the print array and storing the health in a non-transitory memory of the printing machine.

9. The method of claim 8 wherein repositioning at least one moving platform includes repositioning the moving platform such that the print array for the nozzles aligns over a beam light from the drop detection sensor when firing.

10. The method of claim 8 wherein repositioning at least one moving platform includes repositioning the additional platform such that the drop detection sensor aligns under the nozzles of the print array if firing.

11. The method of claim 8 wherein repositioning at least one moving platform includes repositioning both the moving platform and the additional moving platform at the synchronized speed.

12. The method of claim 8 further comprising positioning at least one moving platform to align a first nozzle of the print array with the drop detection sensor followed by continually repositioning at least one moving platform for the drop detection sensor to scan each nozzle in the print array firing.

13. The method of claim 8 wherein identifying a health of the nozzles includes comparing measurement values for each nozzle fired to stored values and determining whether the measured values are outside a tolerance of the stored values.

14. The method of claim 8 further comprising determining at least one from the group consisting of the rate of firing for nozzles in the set of nozzles, the distance between nozzles in the set of nozzles, a total number of nozzles in the set of nozzles, a length of the beam light emitted from the drop detection sensor, an amount of time to refresh nozzles in the set of nozzles, and a speed and position tolerance of at least one moving platform.

15. A machine-readable storage medium encoded with instructions that if executed cause a print controller of a print machine to:

identify a synchronized speed to reposition at least one moving platform of a printing machine based on a rate of firing from nozzles in a print array and a distance between the nozzles in the print array;

reposition at least one of the moving platform at the synchronized speed for a beam light from a drop detection sensor to scan nozzles in the print array firing;

wherein the print array is coupled to a moving platform and the drop detection sensor is coupled to an additional moving platform; and store a health of the nozzles in a non-transitory memory of the printing machine based on measurements from the beam light of the drop detection sensor.

16. The machine-readable storage medium of claim 15 wherein the print controller additionally determines a current position of the drop detection sensor by pre-firing nozzles from the print array or by scanning a digital map of nozzles.

17. The machine-readable storage medium of claim 15 wherein the print controller further positions at least one moving platform such that the drop detection sensor and a first nozzle of the set of nozzles are aligned so as to synchronize with the set of nozzles.

18. The machine-readable storage medium of claim 15 wherein the print controller determines whether the drop detection sensor has scanned and measured the health of all of the nozzles in the print array before advancing to scan an additional set of nozzles on another print array.

19. The machine-readable storage medium of dam 15 wherein the print controller instructs the drop detection sensor to re-scan at least one nozzle from the print array if a nozzle health of at least one nozzle from the print array was not identified.

* * * * *

UNITED STATES PATENT AND TRADEMARK OFFICE

CERTIFICATE OF CORRECTION

PATENT NO. : 8,172,356 B2
APPLICATION NO. : 12/464244
DATED : May 8, 2012
INVENTOR(S) : Laura Portela et al.

It is certified that error appears in the above-identified patent and that said Letters Patent is hereby corrected as shown below:

In column 11, line 10, in Claim 2, delete "nozzles;" and insert -- nozzles, --, therefor.

In column 12, line 50, in Claim 19, delete "dam" and insert -- claim --, therefor.

Signed and Sealed this
Fifth Day of March, 2013

Teresa Stanek Rea
*Acting Director of the United States Patent and Trademark Office*